United States Patent [19]

Pater et al.

[11] Patent Number: 4,762,277

[45] Date of Patent: Aug. 9, 1988

[54] APPARATUS FOR ACCELERATING SLUGS OF LIQUID

[75] Inventors: Larry L. Pater, Zelienople; Aubrey C. Briggs, Rosslyn Farms, both of Pa.

[73] Assignee: Briggs Technology Inc., Pittsburgh, Pa.

[21] Appl. No.: 129,915

[22] Filed: Dec. 3, 1987

Related U.S. Application Data

[63] Continuation of Ser. No. 821,806, Jan. 23, 1986, abandoned, which is a continuation-in-part of Ser. No. 447,000, Dec. 6, 1982, Pat. No. 4,573,637.

[51] Int. Cl.[4] ..... B05B 1/08

[52] U.S. Cl. ..... 239/99; 239/101; 239/533.15; 137/312; 137/509; 137/624.14; 137/906; 251/355; 299/17

[58] Field of Search ..... 239/94, 99, 101, 533.15, 239/102.1; 137/312, 509, 624.14, 906; 251/355; 299/17

[56] References Cited

U.S. PATENT DOCUMENTS

| | | | |
|---|---|---|---|
| 1,998,056 | 4/1935 | Naatz et al. | 251/355 X |
| 2,891,570 | 6/1959 | Krupp | 137/906 |
| 3,204,876 | 9/1965 | Elverston | 239/533.15 X |
| 3,343,794 | 9/1967 | Voitsekhovsky . | |
| 3,412,554 | 11/1968 | Voitsekhovsky et al. . | |
| 3,647,137 | 3/1972 | Naydan . | |
| 3,883,075 | 5/1975 | Edney . | |
| 3,905,552 | 9/1975 | Hall et al. . | |
| 3,921,915 | 11/1975 | Glenn et al. . | |
| 4,177,926 | 12/1979 | Hunter | 239/99 |
| 4,195,885 | 4/1980 | Lavon | 299/17 X |
| 4,301,967 | 11/1981 | Hunter | 239/99 |
| 4,573,637 | 3/1986 | Pater et al. | 239/99 X |

*Primary Examiner*—Andres Kashnikow
*Assistant Examiner*—Mary Beth O. Jones
*Attorney, Agent, or Firm*—Parmelee, Miller, Welsh & Kratz

[57] ABSTRACT

Discrete volumes, or slugs, of liquid are accelerated to high velocities utilizing energy stored by compressing the liquid. Liquid is forced into a pressure vessel already filled with liquid to effect the compression. A slug of liquid is ejected from the pressure vessel into a cumulation nozzle by the energy stored in the compressed liquid when a valve is rapidly opened. The valve is unseated when an unseating force exceeds a closing bias. The valve is then opened rapidly by an opening force generated by the compressed liquid. By repetitively introducing highly pressurized liquid into the pressure vessel, the valve automatically cycles to generate a series of pulsed liquid jets. Rapid opening of the valve is aided by an extension on the valve member which sealingly slides inside the passage of the cumulation nozzle to block release of liquid until the valve member accelerates sufficiently that the required opening rate is achieved as the extension clears the nozzle passage.

24 Claims, 6 Drawing Sheets

APPARATUS FOR ACCELERATING SLUGS OF LIQUID

CROSS-REFERENCE TO RELATED APPLICATION

This is a continuation of co-pending application Ser. No. 821,806, filed on Jan. 23, 1986, now abandoned, which is a continuation-in-part application of our commonly assigned, co-pending application Ser. No. 447,000, filed Dec. 6, 1982, now U.S. Pat. No. 4,573,637.

BACKGROUND OF THE INVENTION

1. Field of the Invention

The present invention relates to an apparatus for accelerating discrete volumes or slugs of liquid, and more particularly to accelerating slugs of liquid through utilization of energy and mass stored in compression of the liquid in a closed container.

2. Prior Art

There is a need for increased productivity in cutting and breaking hard, strong substances such as rock, pavement and frozen earth. One current method of achieving this end is the use of explosives, usually placed in laboriously drilled holes and cavities. The process is noisy, dangerous, and is a batch, as opposed to a continuous, process that is typically slow and expensive. Another method utilizes the mechanical impact breaker, typified by the familiar jackhammer. Such devices are well developed and in widespread use, but are heavy, punishing to the operator, and break rock too slowly.

Yet another method of breaking and cutting hard, strong substances, but one which is not yet in wide use, utilizes a pulsed liquid jet. A pulsed liquid jet can briefly attain very high jet power for moderate connected power, by storing energy over a time period that is long compared to the jet duration. Such jets are well known to the prior art and typically reach velocities of several thousand feet per second and stagnation pressures of several hundred thousand pounds per square inch. Experimental single-shot laboratory results of several investigators have demonstrated the effectiveness of such pulsed jets for breaking and cutting difficult substances such as pavement and rock.

Pulsed jet devices preferably use a "cumulation" nozzle, such as that disclosed, for instance, in U.S. Pat. No. 3,343,794 to Voitsekhovsky, in which an energetic slug of liquid is supplied at the entrance of a dry nozzle. The foremost portion of the water slug is greatly accelerated as it travels along the contracting passage, which concentrates most of the slug energy into the kinetic energy of a small portion of the fluid slug. The resulting transient liquid jet that exits from the nozzle has a peak stagnation pressure many times higher than the static pressure that occurs anywhere within the nozzle, which is of great practical advantage. The internal shape of the nozzle has a profound effect on the wall pressures that occur within the nozzle as is well known in the prior art as demonstrated by U.S. Pat. No. 3,921,915.

The aforementioned experimental results were for the most part obtained using single-shot laboratory apparatus. A successful commercial apparatus must be capable of sustained production of such pulsed liquid jets at a useful repetition rate under field conditions. Most prior inventions utilizing cumulation nozzles have energized the water slug by impact of a moving mass as disclosed for example, in U.S. Pat. Nos. 3,343,794; 3,412,554; 3,905,552; and 3,921,915. In such devices, the pulse energy available to power the liquid jet is the kinetic energy of the impacting mass which must be accelerated by some means such as gravity, a propellant charge or compressed gas. Means must also be provided to empty the nozzle, replenish the liquid slug and maintain the shape and location of the water slug in preparation for each pulse. Previous inventions typically utilize an intermediary piston or diaphragm between the liquid slug and impacting mass and a valve or diaphragm between the liquid slug and the nozzle entrance. Such diaphragms must be replaced before each pulse and the motion of a valve must be closely synchronized with the impact of the moving mass. An intermediary piston must provide for purging of air from the liquid packet chamber. Material considerations, specifically allowable stress, limit the mass impact velocity. Since kinetic energy is proportional to the product of velocity squared and mass, large values of pulse energy require a large moving mass. The result is a heavy apparatus. In addition, the recoil impulse associated with acceleration of a large mass to a high value of kinetic energy results in a tool that is difficult to control. A proposed alternate means of energizing the liquid is spark discharge as disclosed in U.S. Pat. No. 3,647,137. However, this approach requires the supply and rapid switching of large quantities of electrical energy.

U.S. Pat. No. 3,883,075 suggests yet another method of producing a liquid pulsed jet. Under this approach, a multi-channel nozzle block is rotated in front of an ejector supplied with a continuous flow of pressurized liquid. In effect, the rotating nozzle block chops the continuous liquid stream. Such devices are cumbersome and require careful synchronization of the parts.

In general, the prior art liquid pulsed jet devices are handicapped by excessive weight and mechanical complexity, low pulse energy, or very low repetitive firing rate.

SUMMARY OF THE INVENTION

According to the present invention, discrete volumes or slugs of liquid are accelerated to high velocities using energy stored by compressing the liquid in a closed container. Liquid is introduced under pressure into a container already filled with liquid to compress it and thereby accumulate energy and mass in the compressed liquid within the container. A slug of the liquid stored in the container is then ejected from the container and accelerated to a high velocity through conversion of the potential energy of the compressed liquid into kinetic energy of the slug. By repetitively introducing additional liquid into the container and ejecting slugs of liquid, a series of pulsed liquid jets is generated.

The apparatus according to the invention consists essentially of a chamber and a nozzle, preferably a cumulation nozzle, separated by a valve. The chamber, formed by a high-strength pressure vessel, is charged with a high-pressure compressed liquid by appropriate means such as a pump or intensifier. The pulse energy and the pulse volume (i.e. the slug of liquid that is ejected through the nozzle) are stored in the slightly compressible working liquid contained in the chamber. Some recoverable energy is also stored in elastic deformation of the chamber walls. The required chamber pressure depends on the volume of the chamber and the desired values of pulse energy and pulse volume; for practical applications, the required pressure may be as low as five thousand (5,000) pounds per square inch and may be as high as about forty thousand (40,000) pounds per square inch or even higher.

When the desired chamber pressure and energy storage have been achieved, the valve is opened, allowing the pressurized liquid to expel into the cumulation nozzle. The volume of liquid expelled, i.e. the pulse volume or slug size, is a small fraction of the chamber volume. The valve must be opened very rapidly to properly utilize the cumulation nozzle. The valve must be substantially fully opened in less time than is required for the leading edge of the liquid slug to reach the nozzle exit. Rapid valve opening is achieved in the preferred arrangement by providing on the end of the valve member, an extension which slides in sealing relation inside the nozzle passage. The length of the extension is such that the valve member can accelerate to the required velocity by the time that the extension, which initially blocks release of liquid into the nozzle, clears the nozzle passage inlet. The preferred means of actuating the valve is to utilize the rapid expansion capability of the highly compressed luquid. This is achieved in a preferred form of the invention by a valve member which seats against the nozzle passage and extends across the pressure chamber and through the housing on the opposite side or extends within a bore of a center body of the chamber. The portion of the valve member which passes through the housing or slides within the center body bore is larger in cross-section than the portion which seats against the nozzle passage such that the compressed liquid exerts an opening force on the valve member. When the pressure of the compressed liquid reaches a point where the opening force exceeds a closing bias applied to the valve member, the valve opens to expel liquid until the pressure drops sufficiently for the bias force to reclose the valve. The valve motion is further controlled by means of an energy dissipation device which serves to limit the valve velocity to the desired maximum value and then slows the valve gently to a stop so that the bias force may return the valve to the closed position. With additional pressurized liquid supplied to the chamber, this valve arrangement will automatically cycle to repetitively produce pulsed liquid jets.

In another preferred form of the invention, the portion of the valve member which passes through the housing or slides within the bore of the center body is smaller in cross-section than the portion which seats against the nozzle passage such that the compressed liquid exerts a closing force on the valve member. A hydraulic actuation device or other suitable means supplies an unseating force to the valve member causing it to move from its engaged position with the nozzle passage. Once the valve member is unseated, it will very rapidly accelerate to an open position due to the large opening force exerted by the pressurized liquid within the housing by virtue of the fact that the extended portion of the valve member within the nozzle passage has a diameter smaller than the portion which passes through the housing or slides within the center body. After a slug of liquid has been ejected into the nozzle passage, the valve member is moved to the closed position by a suitable hydraulic device or biased by a mechanical or compressed gas spring into seated engagement with the nozzle passage, at which point the liquid pressure within the chamber increases and holds the valve member in the closed position until it is again opened by application of the unseating force. Automatic or manual cycling is achieved through the use of a transducer device or the like, which senses and signals within a predetermined range of liquid pressures in the chamber to control the opening and closing of the valve member through known circuitry and control means.

The described arrangement eliminates impact and the associated high material stresses, and also avoids the weight penalty of a separate energy storage means required in many of the prior art devices. It is also simple, does not require precise synchronization of parts as required in other pulsed liquid jet devices, and can reliably generate high energy pulses at a high repetition rate.

DETAILED DESCRIPTION

Figure 1:
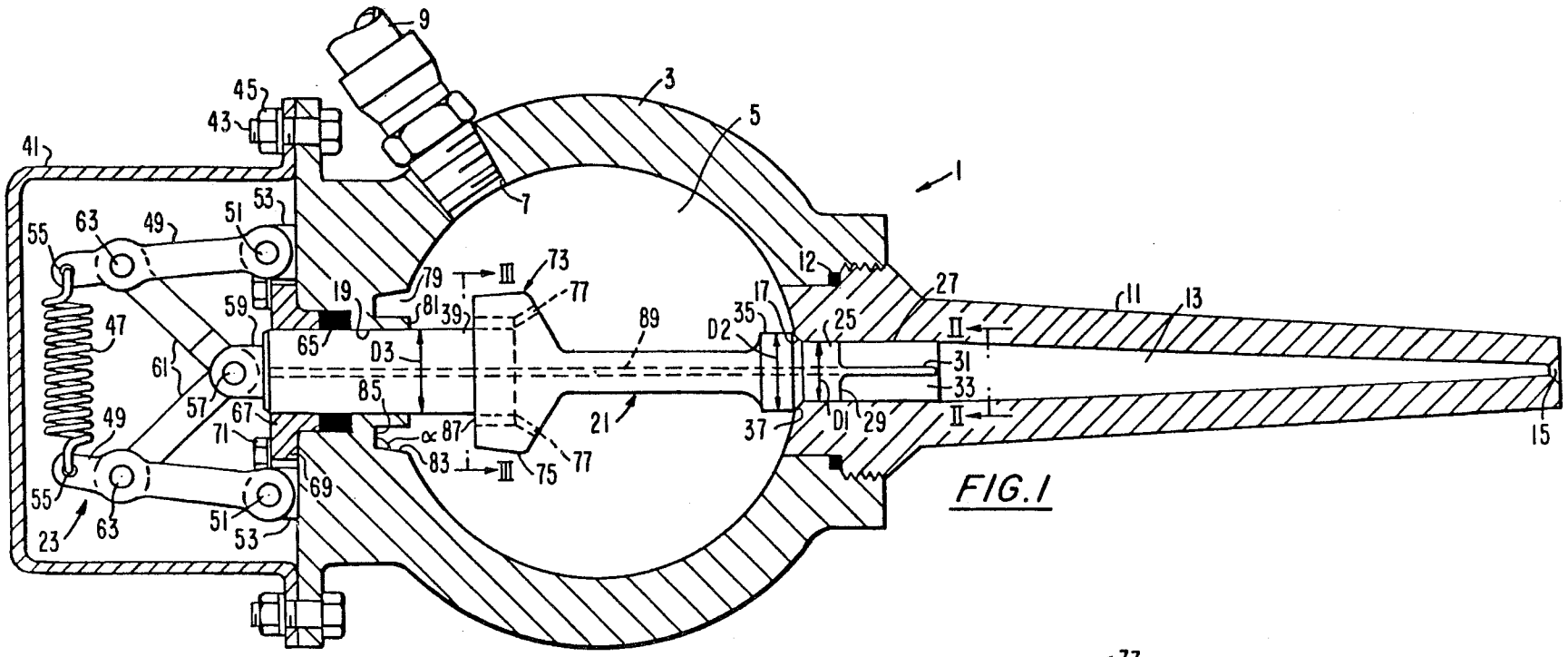
FIG. 1 is a cross-sectional view through an apparatus incorporating the present invention.

Referring now to the drawings, FIG. 1 illustrates the apparatus 1 of the present invention, usable for the repetitive production of pulsed liquid jets. As illustrated, the apparatus comprises a high strength pressure vessel in the form of a housing 3, which defines a chamber 5, the housing 3 having an inlet 7 for introduction thereto of a liquid. The housing 3 is illustrated as being spherical, although it may be of other shapes as required to facilitate fabrication or utilization of the apparatus. A line 9, preferably a flexible hose, is connected to a means such as a pump (not shown) for charging of liquid under pressure through inlet 7 into the chamber 5. The hose may be flexible or rigid, and there may be provided an accumulator vessel (also not shown) at some point therealong to control pressure fluctuations. A cumulation nozzle 11, having a passage 13 therethrough which diminishes in cross-sectional area toward an outlet 15, is secured to the housing 3, with the passage 13 communicating with chamber 5. The nozzle 11 may be formed as an integral part of the housing 3, or it may be detachable as illustrated in FIG. 1. The nozzle 11, if detachable, is securely mated to the housing 3 by any suitable means such as a threaded connection or by other means, e.g. a bolted flange. A seal, 12, should then be provided to prevent escape of pressurized liquid at the juncture of the housing 3 and nozzle 11. A valve seat 17 surrounds the entry to passage 13, and the housing 3 has, in the wall opposite the entry to passage 13, an opening 19.

Figure 2:
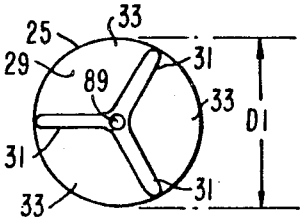
FIG. 2 is an enlarged view taken along line II—II of FIG. 1.

A slidable valve member 21 is urged by a biasing device 23 into sealing relationship with the valve seat 17 to seal the passage 13 of the nozzle 11 from the chamber 5. The valve member 21 extends through the chamber 5 and has first, second and third portions of increasing cross-sectional area. The first portion 25 of the valve member 21 is slidable in close fitting sealing relation within the inlet portion 27 of the passage 13 of nozzle 11 and is provided on the end 29 thereof with guide vanes 31, for example, three as shown, which are slidable along the walls of passage 13. As best seen in FIG. 2, channels 33 are formed by the guide vanes 31 through which liquid can be expelled from the chamber 5 into the nozzle passage 13 when the valve member 21 is operated to the open position.

The second portion 35 of the valve member 21 has a shoulder 37 which mates with the valve seat 17, while the third portion 39 of the valve member 21 extends through opening 19 in the wall of housing 3. The first portion 25, second portion 35, and third portion 39 are of increasing cross-sectional area, as shown in the drawing, where D1 is smaller than D2 which is smaller than D3.

The biasing means 23, which is preferably contained in a cap 41 affixed to the housing 3, for instance, by means of bolts 43 and nuts 45, applies a biasing force to the slidable valve member 21. The biasing means maintains the shoulder 37 of the second portion 35 of the slidable valve member 21 in sealing relationship with the valve seat 17. As illustrated, the biasing means 23 provides for a decreasing biasing force to be exerted as the slidable valve member 21 moves away from the valve seat 17. The illustrated biasing means 23 comprises a spring 47 and two pairs of pivotally connected arms. Arms 49 of the first pair are pivotally attached by pins 51 to mounts 53 on the housing 3 and are connected together at their free ends by the tension spring 47 hooked through holes 55 in the arms. The arms 61 of the second pair are each pivotally connected at one end by a common pin 57 to an extension 59 on valve member 21 and at the other end to one of the arms 49 by a pivot pin 63. Since the bias means applies a decreasing force as the valve member approaches the open position, less energy is stored by this mechanism which permits more rapid acceleration of the valve member during valve opening and softer impact of the valve member during closing.

The third portion 39 of valve member 21, as discussed, extends through the opening 19 in the housing which is provided with annular seal 65 to prevent leakage of compressed liquid from chamber 5 as the portion 39 slides in and out in opening 19. The seal 65 is held in place by a block 67 having a flange 69 that is secured to the housing 3 by securing means such as bolts 71.

As will be described in more detail below, the valve member 21 is opened rapidly to release a slug of liquid from the chamber 5. In order to stop the rapidly moving valve member 21 and absorb its kinetic energy as it approaches the full open position, energy absorbing decelerating means are provided. The device provided utilizes the liquid in the chamber 5 for hydraulic dampening. A cup-shaped member 73 is coaxially mounted on the second portion 35 of the valve member 21 with the generally annular flange 75 thereof extending in spaced relation around the third portion 39 of the valve member. This annular flange 75 forms a plunger which is received in an annular recess 79 in housing 3 surrounding opening 19 and spaced therefrom by a shoulder 81, as the valve member 21 approaches the full open position. The outer wall 83 of annular recess 79 extends outwardly at an obtuse angle $\alpha$ from the base 85 of the recess, while the outer surface of annular flange 75 tapers inwardly at the same angle. Apertures 77 extend through the cup-shaped member 73 to connect the bottom of the annular space 87 formed between the flange 75 and the portion 39 of the valve member 21 with the chamber 5.

Vacuum breaker means for the nozzle passage 13 is provided in the form of a passage 89 extending axially through the valve member 21. The end of the passage 89 in portion 39 of the valve member 21 may be open to the atmosphere as shown to allow the remaining liquid to flow out of the nozzle passage 13 through its own momentum and/or gravity. Alternatively, a vacuum could be applied to passage 89 although this would present the danger of sucking debris into the nozzle in some applications. Preferably, passage 89 is connected to a source of positive gas pressure (not shown) to expel substantially all remaining liquid from the nozzle passage 13 between pulses.

In the operation of the present invention, the hose 9 is connected to a source of liquid, under pressure, with the valve member 21 in the closed position shown in FIG. 1, sealing off passage 13 of the nozzle 11. As additional liquid is charged to the chamber, the liquid, such as water, will be compressed and the pressure in the chamber will increase so that energy and liquid mass are stored. When the force exerted by the pressurized liquid in the chamber 5 on the valve member 21 due to the greater cross-sectional area of the portion 39 relative to the portion 35 exceeds the force exerted by biasing means 23, the valve member 21 will begin to move toward the open position unseating the second portion 35 from the valve seat 17. Since the first portion 25 of the valve member 21 is closely fit in slidable sealing relation within the inlet portion 27 of the nozzle passage 13, almost no fluid escapes from the chamber at this point. However, since the shoulder 37 formed by the difference in diameters between the portions 35 and 25 is now exposed to the pressurized liquid in chamber 5 to increase the opening force, the valve member 21 is further accelerated toward the open position. In addition, as discussed above, the bias means shown exerts a decreasing bias force as the valve opens to reduce opposition to the opening forces and permit additional acceleration of the valve member 21.

The length of the first portion 25 of the valve member 21, which continues to block the flow of liquid into the nozzle passage 13, is selected such that the valve member reaches sufficient velocity by the time that the end 29 of portion 25 clears the nozzle passage inlet that the valve is substantially fully opened in less time than is required for the leading edge of the liquid slug to reach the nozzle exit 15. The valve is fully opened when the cross-sectional area of the valve opening substantially equals that of the nozzle passage inlet 27. This is important to proper operation of the cumulation nozzle and effects efficient conversion of potential energy stored in the compressed liquid in chamber 5 into kinetic energy of the slugs of liquid injectd into the cumulation nozzle 11. The guide vanes 31 remain inside the nozzle passage 13 throughout the full travel of the valve member 21 to maintain alignment of the parts.

The valve member 21 gains considerable kinetic energy in accelerating to the velocity required for rapid injection of liquid into the nozzle 11. In order to stop the valve member 21 preparatory to closing the valve, this energy must be absorbed in a short distance while a considerable opening force is still being applied to the valve member by the liquid in chamber 5. As the valve member 21 approaches the full open position, the flange 75 on cup-shaped member 73 begins to enter the annular recess 79. Liquid in the recess 79 is forced out through the clearance between the flange 75 and the outer wall 83 of the recess to generate a force which retards the opening movement of the valve member 21. The taper of the outer wall 83 of the recess 79 and the outer surface of flange 75 narrows the clearance between the flange and recess as the flange enters the recess thereby maintaining a large deceleration force as the velocity of the valve member 21 decreases. Liquid trapped in the annular space 87 inside the cup-shaped member 73 escapes through the apertures 77 to prevent forcing the trapped liquid beyond the seal 65.

Ejection of liquid into the passage 13 of nozzle 11 causes the chamber pressure, and thus the opening force exerted on valve member 21, to decrease. When this opening force falls below the closing force generated by the biasing means 23, the valve member 21 moves to the closed position with the first portion 25 in sealing relation inside nozzle 13 and with the shoulder 37 seated against seat 17 thereby enabling repressurization of the liquid in chamber 5 for a repeat cycle. So long as pressurized fluid is supplied through line 9, the cycle will be automatically repeated to generate a continuous series of pulsed liquid jets. The rate at which pressurized liquid is delivered to the chamber 5 by line 9 determines the rate at which the valve cycles. In this manner, the apparatus stores energy over a period of time and releases it at spaced intervals as kinetic energy of slugs of liquid. Thus, the device can produce a high energy pulsed liquid jet with moderate connected power.

As is well known, the cumulation nozzle accelerates the leading edge of the slug of liquid injected into the nozzle passage 13 by concentrating the kinetic energy of the slug in the forward portion. This can result in the trapping of some low energy liquid in the nozzle passage 13 by the vacuum created behind the trapped liquid when the valve member 21 is returned to the closed position. Such trapped liquid must be removed from the nozzle 11 before the next pulse. Passage 89 breaks the vacuum or admits pressurized gas or air so that the nozzle passage 13 is essentially free of liquid by the time the next slug is ejected into the nozzle.

Figure 3:
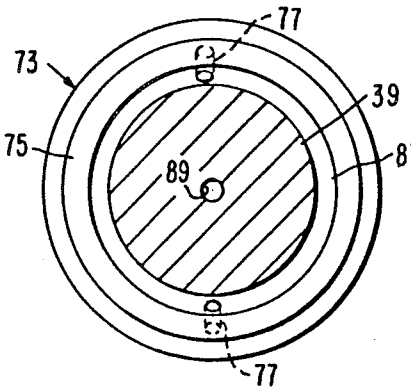
FIG. 3 is an enlarged view taken along line III—III of FIG. 1.
Figure 4:
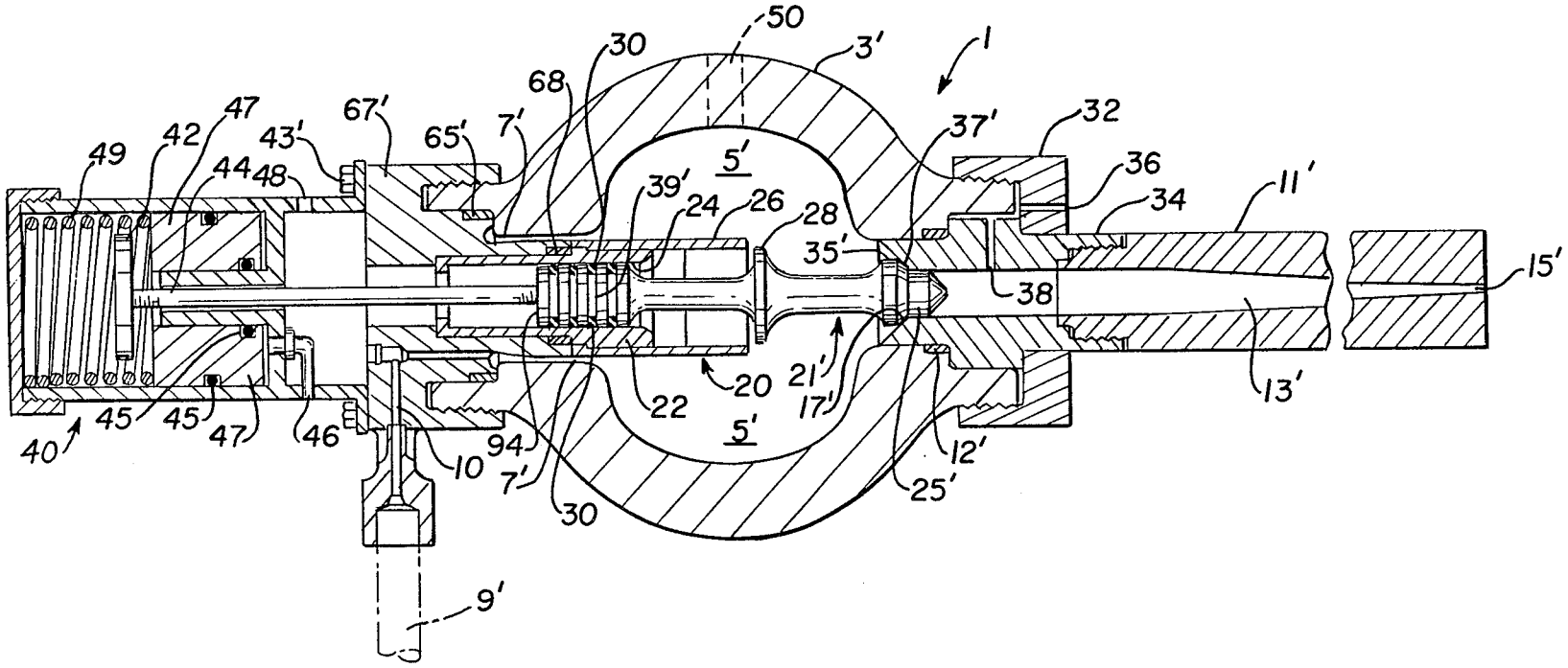
FIG. 4 is a partially fragmented, cross-sectional view of another presently preferred embodiment of an apparatus incorporating features of the present invention.

Additional embodiments of apparatus incorporating the present invention are depicted in FIGS. 4–9, in which similar mechanical elements corresponding with those previously described in FIG. 1 are designated by "primed" numbers. The device depicted in FIG. 4 is suitable for manual, automatic or semiautomatic operation due to the configuration of valve member 21' employed therein. Contrary to the construction of the previously described embodiment of FIGS. 1–3, the diameter of second portion 35' of the valve member 21' is greater than the diameter of its third portion 39'. Thus pressurized liquid within the closed chamber 5' urges the shoulder 37' of the valve member 21' into sealing engagement against the valve seat 17' to close-off the passage 13' of the nozzle 11'. The diameter of the first portion 25' of the valve member 21' is smaller than the diameter of the third portion 39'. As will be explained hereinafter, when an unseating force is applied to the valve member 21', the shoulder 37' is moved away from sealing relation with the valve seat 17', whereby the pressurized liquid in the chamber 5' exerts an opening force on the valve member 21', tending to accelerate the valve member 21' toward the open position.

The valve member 21' does not extend through an opening in the housing 3' as in the device of FIG. 1, but rather is slidably fitted within a cylindrically shaped center body 20. Center body 20 is located at a side of the housing 3' opposite the valve seat 17' and extends into the interior of chamber 5'. This arrangement facilitates reduction of the length and mass of the valve member 21'. The center body 20 of FIG. 4 is comprised of a cylinder 22 having a central bore 24 formed therein which slidably receives the third portion 39' of the valve member 21' therein. The rear of the cylinder 22 is secured within the end block 67', which in-turn is threadably secured to the housing 3'. A stationary ring seal 65' is fitted between the block 67' and housing 3' to prevent leakage of compressed liquid from the chamber 5' and the adjacent liquid inlet 7'. A pressurized source of liquid is fed from a hose or pipe 9' to a passage 10 formed within the end block 67' which communicates with the inlet 7'. A second stationary ring seal 68 is seated between the end block 67' and the cylinder 22 to prevent liquid leakage therebetween. A cylindrical skirt 26 is secured around the cylinder 22 and extends outwardly therefrom to receive an enlarged plunger section 28 of the valve member 21' therein which serves to decelerate the valve member during the opening thereof. As the valve member 21' approaches the open position, the plunger 28 enters the throat of the cylindrical skirt 26 and traps liquid therein which exerts a deceleration force on the member 21'. The bore of the cylindrical skirt 26 may be tapered or otherwise contoured so that the peripheral radial clearance formed with the plunger 28 varies as the plunger 28 moves into and within the cylindrical skirt 26, yielding a deceleration force that varies with the position and velocity of the valve member 21' in an optimal manner. The third portion 39' of the valve member 21' contains one or more spaced-apart, circumferential grooves into which are fitted one or more ring-shaped seals 30 which slidably and sealably engage the bore 24 of the center body 20 to prevent leakage of pressurized liquid from the chamber 5' along the interface between the valve member 21' and the bore 24 of the center body.

In order to open the valve member 21', which is normally held in the closed position by the force of the pressurized liquid in the chamber 5', a hydraulic actuation device 40 of known type is provided, secured to the end block 67' by way of bolts 43'. Slidably fitted within the hydraulic actuation means 40 is a hollow cylindrical piston 47 provided with slidable seals 45. A rod 44 is attached by a threaded connection or other suitable means to the end 94 of the third portion 39' of the valve member 21'. The rod 44 is provided with a larger diameter end portion 42 which is adapted to engage the end of the hollow cylindrical piston 47. The hydraulic actuation means 40 also includes a fluid orifice 46 for the introduction and exhausting of hydraulic fluid. Pressurized air or gas, introduced through orifice 48, acts on the end 94 of the third portion 39' of the valve member 21', providing a bias force that tends to exert a closing force on the valve 21'. A pressure sensing means, such as a known transducer device 50, is mounted within the walls of the housing 3' (shown) or along the supply line 9' with its sensing end communicating with the liquid within the chamber 5'. When the liquid pressure within the closed chamber 5' reaches a predetermined level by way of liquid flow through inlet 7', the transducer device 50 transmits a signal through appropriate, known circuitry and control means (not shown) to activate the hydraulic actuation means 40, by supplying hydraulic fluid under pressure into orifice 46 and thereby causing the cylinder 47 to exert an unseating force on the enlarged portion 42 of the rod 44, and thus causing the shoulder 37' of the valve member 21' to be pulled away from sealing engagement with valve seat 17'. Since the first portion 25' of the valve member 21' is of a smaller diameter than the third portion 39', the pressurized compressed liquid contained within chamber 5' exerts an opening force on the valve member 21', accelerating the valve member 21' toward the open position. The nelarged portion 42 attached to the rod 44 accelerates away from the cylindrical piston 47, so that said piston 47 is not required to duplicate the rapid motion of the valve member 21'. A liquid slug is ejected from the chamber 5' into the nozzle 13' when the first section 25' of the valve member 21' no longer blocks the inlet to the nozzle passage 13'. Ejection of a slug of liquid into the passage 13' of the cumulation nozzle 11' causes the pressure within chamber 5' to decrease. When the liquid pressure, sensed by the transducer device 50, falls below a specified level within the chamber 5', the control means ceases to supply hydraulic fluid under pressure to orifice 46. A coil spring 49 then returns the cylindrical piston 47 to its original position. The valve member 21' is decelerated gently to a stop by the action of the plunger section 28 moving within the cylindrical skirt 26 and also by the action of the bias force exerted on the end 94 of the valve member 21' by the compressed gas introduced through orifice 48. The bias force then moves the valve member 21' forward into sealing engagement with the valve seat 17' of the nozzle 11'. Liquid is replenished within the chamber 5' by way of inlet 7'. The repetitive cycle continues as the pressure sensing device 50 detects an increase in liquid pressure and causes the opening of the valve 21' by actuation of the hydraulic device 40. Other methods of separating the shoulder 37' of the valve 21' from the valve seat 17', in lieu of hydraulic actuation device 40, such as levers, cams, solenoid actuators, etc., will be obvious to one skilled in the art and are deemed to be included herein.

The cumulation nozzle 11' of the device depicted in FIG. 4 is shown as a two-piece detachable design. A locking collar 32 is threadably connected to the housing 3' and secures the nozzle base element 34 thereto. The detachable nozzle 11' is then threadably secured to the base element 34. In this manner, nozzle 11' is easily removed for inspection, maintenance or for compact transport of the apparatus 1. An air or gas passage 36 formed through the locking collar 32 communicates with a second passage 38 formed through the base element 34 to communicate with the nozzle passage 13'. Passages 36 and 38 provide a means for the introduction of a pressurized gas such as air of nitrogen within the nozzle passage to break the vacuum therein and clear liquid from the passage 13' after each slug is ejected into the nozzle, as previously described.

Figure 5:
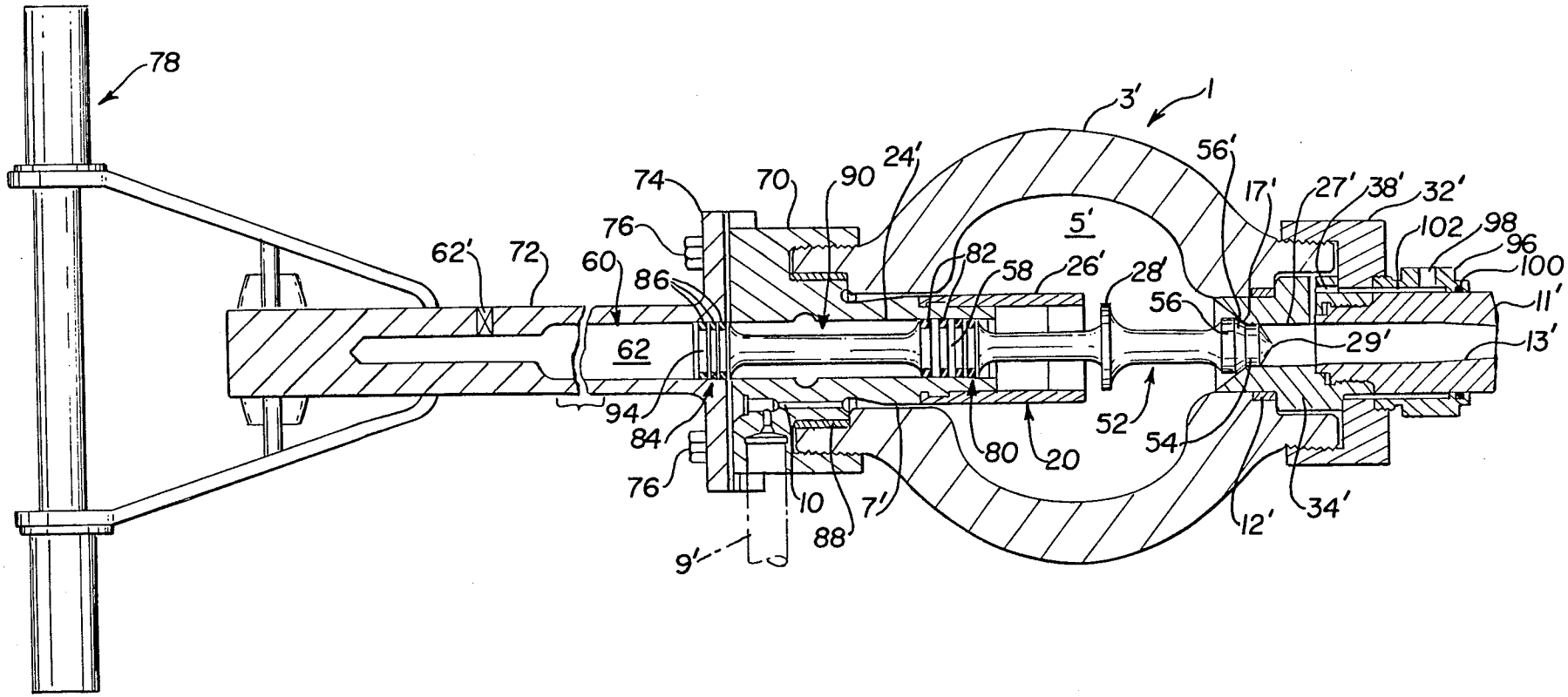
FIG. 5 is a partially fragmented, cross-sectional view of still another embodiment incorporating the present invention.

Another presently preferred embodiment or our invention is illustrated in FIG. 5. The apparatus 1 of FIG. 5 is similar, in most details of construction, to those previously described in FIGS. 1 or 4. In this device a compressed fluid biasing means 60, preferably in the form of a compressed gas spring, is employed in place of the previously described mechanical spring device 23 of FIG. 1. In FIG. 5, a slidable valve member 52 is urged by the biasing means 60 into sealing relationship with the valve seat 17' to close-off the passage 13' of the cumulation nozzle 11' from the chamber 5'. The valve member 52 extends within the chamber 5' and, like the device of FIG. 1, has first, second and third portions of increasing cross-sectional area. The first portion 54 of the valve member 52 is slidable in close fitting, sealing relation within the inlet portion 27' of the passage 13' of the nozzle. The end of the valve member 52 has a tapered nose 29'. In this embodiment, there is no need for the guide vanes 31 of FIG. 1, because the tapered nose 29' adequately centers the valve member during its closing stroke by virtue of the fact that valve member 52 is slidably guided within the bore 24' of the center body 20.

The second portion 56 of the valve member 52 has a shoulder 56' which mates with the valve seat 17' to seal-off the nozzle passage 13' when the valve member 52 is in the closed position. The third portion 58 of the valve member 52 slidably extends through the bore 24' of the center body 20. The rearward end 94 of the third portion 58 of the valve member 52 faces an enclosed storage chamber 62 which contains the compressed fluid of the biasing means 60. As in the previously described embodiment of FIG. 1, the first portion 54, second portion 56 and third portion 58 are of increasing cross-sectional area. An end block 70 is threadably attached to the housing 3' and forms the cylindrical bore 24' of the center body 20. A stationary seal 88 is positioned between the end block 70 and the housing 3' to prevent pressurized liquid from leaking therebetween. A conduit 9' is connected to a source of pressurized liquid, which enters the closed chamber 5' by way of passageway 10 in end block 70 and then by way of an annular passageway forming inlet 7', surrounding the center body 20 adjacent to the sidewalls of the housing 3'. A tube-like member 72 carrying a flange 74 is attached by way of bolts 76 to the end block 70 of the housing. Member 72 contains an internal cavity which forms the storage chamber 62 for retaining the compressed fluid such as, for example, compressed gaseous nitrogen. Member 72 also contains a valve member 62' to permit periodic introduction of compressed fluid for resupply to the storage chamber 62 in order to maintain proper pressure therein.

The valve member 52 also has a enlarged diameter plunger section 28' which projects into the throat section 26' of the center body as the valve member approaches the open position. The plunger 28' provides a deceleration force on the valve member 52 as the liquid trapped within the throat section 26' is forced out of the throat section 26' through a restrictive peripheral clearance between the plunger 28' and the bore of the member 26'. The third portion 58 of the valve member 52 is provided with liquid sealing means 80 and fluid sealing means 84. The liquid sealing means 80 comprises one or a plurality of spaced-apart seals 82 fitted within circumferential grooves formed in the valve member 52. Likewise, the compressed fluid seal means 84 comprises one or a plurality of seals 86 fitted within circumferential grooves formed at the end of the third portion 58 of the valve member 52. The liquid sealing means 80 slidably coacts between the valve member 52 and the bore 24' of the center body 20 to prevent the leakage of compressed liquid therethrough. The fluid seal means 84 slidably coacts between the valve member 52 and the bore of the storage chamber 62 to prevent compressed gas leakage therebetween. Hence, the sealing means 80 and 84 provide a sealed-off area 90 therebetween which is both liquid and gas-free. A vent passage 92 is formed between the innerfaces of the end block 70 and the flange 74, communicating at its outer end with the atmosphere and at its inner end with the sealed-off area 90 at the center bore 24' of the center body 20. In the event of a failure in either of the liquid sealing means 80 or the compressed fluid sealing means 84, leaking liquid or fluid would exhaust into the sealed-off area 90 and escape through the vent passage 92. Such leakage is readily detectable by the operator so as to permit appropriate maintenance in order to restore the working efficiency of the device. This arrangement is also a safety feature in that, in the event of a failure of the liquid sealing means 80, the vent passage 92 provides pressure relief for the cavity 90 and thus avoids the possibility that high pressure water might invade the gas spring storage chamber 62.

In operation, the compressed gas within the fluid chamber 62 is at a sufficiently high pressure to forcably bias the end 94 of the third portion 58 of the valve member 52 toward the nozzle, forcing valve surface 56' into sealing engagement with the valve seat 17'. As liquid, such as water, is introduced into the chamber 5' through the conduit 10 and inlet 7', the liquid within the chamber 5' is compressed and the pressure in the chamber increases. When the opening force exerted by the pressurized liquid in the chamber 5' on the valve member 52 exceeds the biasing force exerted by the pressurized gas within storage chamber 62, the valve member 52 will begin to move toward the open position, unseating the shoulder 56' of the second portion 56 from the valve seat 17'. After the first portion 54 clears the valve seat 17' the slug of liquid is ejected from the chamber 5' into the nozzle passage 13'. Ejection of liquid into the passage 13' causes the pressure within chamber 5', and, thus, the opening force exerted on valve member 52, to decrease. When this opening force falls below the closing force generated by the gas spring biasing means 60, the valve member 52 moves into the closed position as previously described. As the valve member 52 moves toward the closed position, it displaces liquid from the chamber 5', which serves to limit the closing speed of the valve member and thus avoid damaging impact of the shoulder 56' on the valve seat 17'. The cycle will automatically repeat to generate a continuous series of pulsed liquid jets so long as pressurized liquid is delivered to the chamber 5'.

A vacuum breaker for the device of FIG. 5 is provided in a collar 96, fitted around the nozzle 11' and threadably attached to the locking collar 32'. Collar 96 carries a gas-tight seal ring 100 at its outer edge, held within a grooved flange around the inner periphery thereof. The collar 96 also has an inlet port 98 to which a source of pressurized gas (preferably air, for economic reasons) is attached. The inlet port 98 communicates with an air passage 102 formed between the collar 96 and the outer periphery of the nozzle 11'. Passage 102 communicates with a passage 38' formed within the base element 34'. The inner end of the air passage 38' communicates with the passage 13' of the nozzle. Pressurized gas flows from its source through the inlet port 98 to passages 102 and 38' and thence to the nozzle passage 13' to clear the nozzle passage 13' of liquid after each pulse.

The device is suitable for use in hand held operations involving the cutting of rock, concrete or other materials. In this regard, the apparatus 1 is fitted with a handle 78 which is rigidly attached to the member 72. The handle 78 may also be fitted with conventional actuation switches or liquid flow control levers (not shown) to control the operation of the device. Larger versions of the device, too large and heavy for hand held use, would be provided with suitable means to attach the device to appropriate handling equipment.

Figure 6:
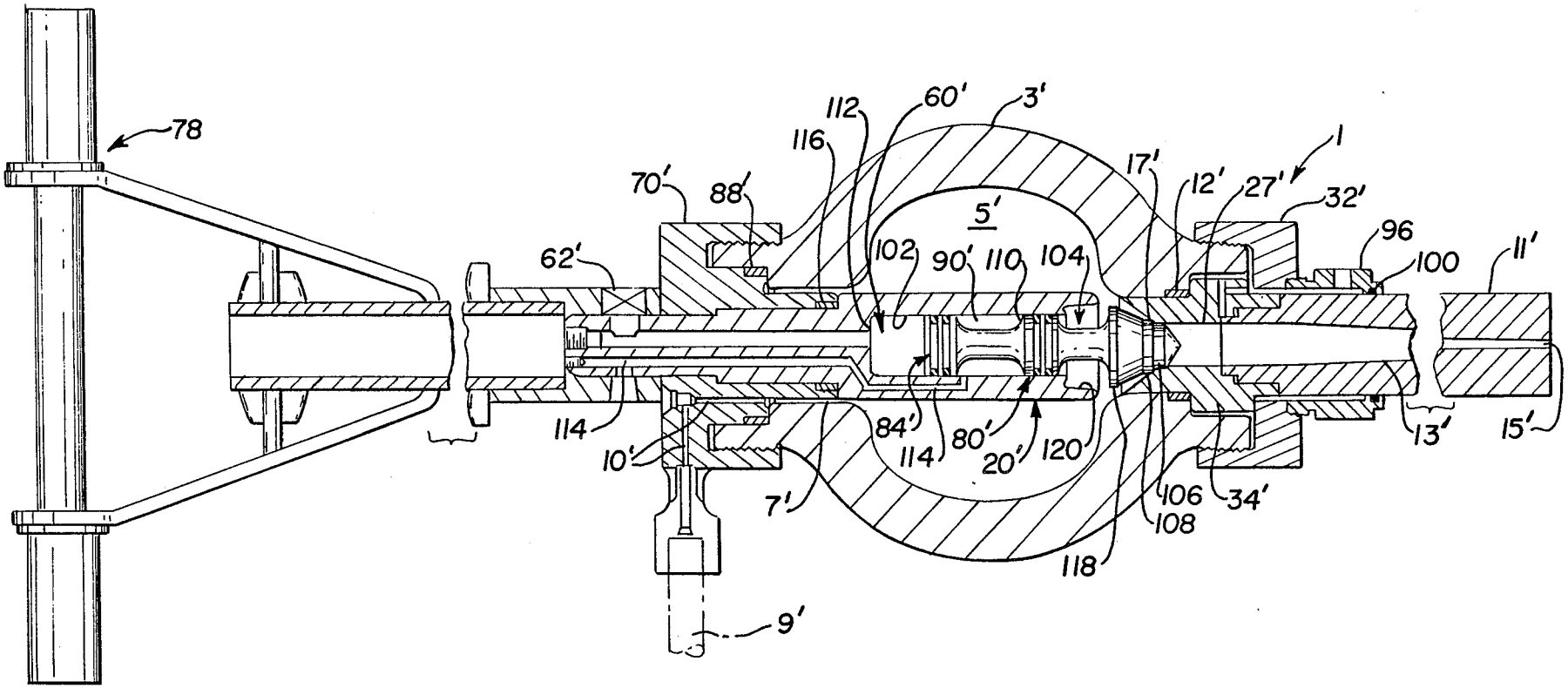
FIG. 6 is a partially fragmented, cross-sectional view of yet another apparatus incorporating the present invention.

Another presently preferred embodiment of the apparatus 1 of the present invention is depicted in FIG. 6, in which the center body 20' is of a one-piece construction. A valve member 104 is slidably positioned within the bore 102 of the center body 20' and is urged by the compressed fluid biasing means in the form of a gas spring 60' into sealing engagement with the valve seat 17', thus closing-off the passage 13' of the nozzle 11' from the chamber 5'. The valve member 104 has first, second and third portions of increasing cross-sectional area, similar to the valve members 21 and 52 depicted in FIGS. 1 and 5, respectively. The first portion 106 of the valve member 104 is slidable in close fitting, sealing relation with the inlet portion 27' of the nozzle passage 13'. The second portion 108 of the valve member 104 has a tapered shoulder which mates with the valve seat 17', while the third portion 110 slidably fits within the bore 102 of the center body 20'. The biasing means 60' is a compressed gas such as nitrogen, introduced through a valve member 62' into the gas storage chamber 112 which is formed within the center body 20'. As in the embodiment of FIG. 5, the apparatus depicted in FIG. 6 includes a valve member 104 which contains fluid sealing means 84' and liquid sealing means 80'. Both of the sealing means 84' and 80' are comprised of one or more seals fitted within grooves formed circumferentially in the valve member 104 for movement therewith along the bore 102 of the center body 20'. The seal means 84' prevents leakage of the compressed fluid, such as nitrogen, of the biasing means 60' into the sealed-off area 90'. The liquid sealing means 80' prevents leakage of compressed liquid, such as water, within chamber 5' rearwardly to the sealed-off area 90'. A vent passage 114 is formed within the center body 20' and communicates at one end with the sealed-off area 90', between the points of travel of the sealing means 84' and 80'. The other end of the vent passage 114 may be in direct communication with the atmosphere or it may be lightly plugged. In the latter case, if a leak should occur in either of the sealing means 80' and 84', the resultant pressure surge within the vent passage 114 would cause the plug to pop from its seat so as to alert the operator as to a potential problem with the seals. The one-piece center body 20' is secured within a central bore of the end block member 70' which, in turn, is threadably secured to the rear of the housing 3'. Also, as previously described, stationary sealing rings 88' and 116 are provided between end block 70' and the housing 3' and between the center body 20' and housing end block 70', respectively, in order to prevent leakage of the compressed liquid from the chamber 5'. As in the previously described embodiments, a source of pressurized liquid, such as water, for example, is connected to the apparatus 1 by way of a conduit 9' which enters the enclosed chamber 5' by way of a passageway 10 formed within the end block 70' to the annular inlet 7' of the housing.

The valve member 104 also contains a flared plunger section 118 which has a diameter slightly smaller than the diameter of the throat 120 of the center body 20'. The plunger 118 acts as a energy absorbing, decelerating means which utilizes the liquid in the throat area 120 for hydraulic dampening in order to assist in stopping the radpidly moving valve member 104 and to absorb its kinetic energy as it approaches the full open position. The apparatus 1 of FIG. 6 also includes a vacuum-breaking means on the nozzle 11', similar to that previously described in the embodiment of FIG. 5. The apparatus likewise can be provided with a handle 78 as shown to permit hand-held operation thereof at the work site, or other suitable means to permit attachement to handling equipment.

Figure 7:
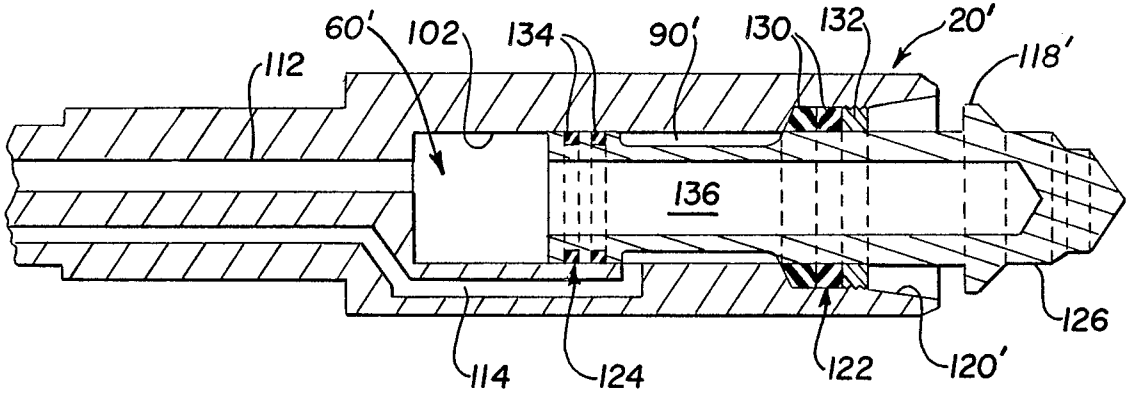
FIG. 7 is an enlarged, partial cross-sectional view of a preferred valve member and center body useful in an apparatus of the present invention.
Figure 8:
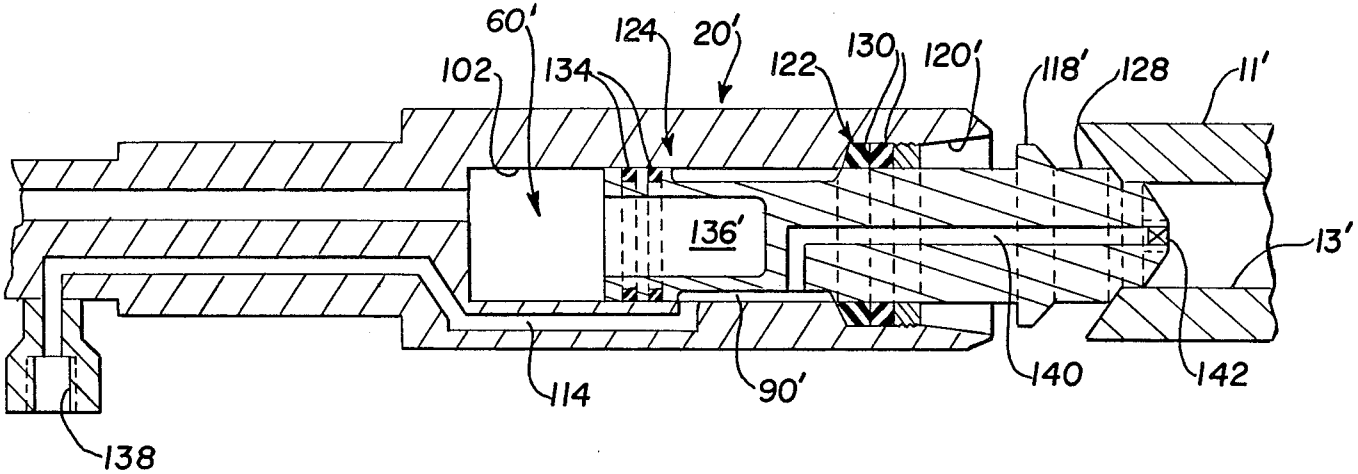
FIG. 8 is a partial fragmentary, cross-sectional view of another preferred embodiment of the valve member and center body similar to FIG. 7.

In the embodiment depicted in FIG. 1, the liquid seal 65 between the housing 3 and the valve member 21 is stationary while those depicted in FIGS. 4 through 6 are moveable with the sliding valve member. Additional arrangements of the various seals are shown in FIGS. 7 and 8, wherein the liquid sealing means 122 is stationary and affixed to the center body 20' while the compressed fluid sealing means 124 is carried by the moveable valve member. The configuration of the center body 20' shown in FIG. 7 is suitable for use in the apparatus of FIG. 6 and would function in the manner previously described, although the sealing arrangement with the valve member is slightly modified. Positioned adjacent to the enlarged throat portion 120' of the bore 102 of the center body 20' is the liquid sealing means 122. The sealing means 122 is made up of one or more seal rings 130. The seals 130 are held securely in place by a threaded locking ring 132 adjacent to the throat 120' of the center of the body 20', whereby the seals 130 are compressively held in sealing engagement against the sliding valve member 126. The fluid sealing means 124 is comprised of one or more ring seals 134 which are carried by the valve member 126 within circumferential grooves formed at its rearward end. In order to decrease the mass of the rapidly moving valve member 126, a portion of the interior thereof is removed to form a hollow cavity 136 therein. This not only yields a lighter device but also provides for improved dampening and deceleration of the valve member 126 due to the decreased mass. A vent passage 114 is also provided in the center body 20' communicating with the sealed-off area 90' of the bore 102 and functions in the manner previously described, in the unlikely event leaks should occur in the sealing means 122 and 124.

The embodiment of valve member 128 shown in FIG. 8 provides a unique vacuum breaking means for directly injecting a compressed gas into the nozzle passage 13'. A passage 140 is formed within the valve member 128 having one end in communication with the sealed-off area 90' and the other end in communication with the passage 13' of the nozzle 11' when the valve member 128 is in the closed position depicted in the drawing. Hence, pressurized gas from a source attached to an external orifice 138 flows through the passage 114 to the sealed-off area 90' of the bore 102 of the center body and, thence, flows to the passage 140 whereupon it enters the nozzle passage 13' to expel liquid which may remain therein after a slug has been ejected. In order to prevent high pressure liquid within the chamber 5' from entering the passage 140 while the valve member moves to the open position, the outlet end of the passage 140 is fitted with a one-way check valve 142. The pressurized liquid in chamber 5' causes the one-way check valve 142 to close-off the passage 140 when the valve member 128 moves from the closed to the open position. Pressurized gas flowing in the opposite direction within the passage 140 is at a much lower pressure than the liquid within chamber 5' and, hence, will not cause an opening of the one-way valve 142 until the valve member 128 is in the closed position shown in FIG. 8.

The unique vacuum breaking means of FIG. 8 also permits the introduction of a lubricant into the cavity 90' to provide for the lubrication of the seal elements in the liquid and fluid sealing means 122 and 124. Since there is a tight fit between the sliding seals 134 and the bore 102, as well as between the stationary seals 130 and the sliding valve member 128, it is sometime advantageous to supply a lubricant at the interface between these sealing elements so as to decrease frictional wear and thus increase the life of these elements. Lubricant, admixed with the vacuum breaking gas, flows through the orifice 138 into the vent passage 114 and, thence, into the sealed-off area 90' of the bore 102. The opening and closing action of the valve member 128 distributes the lubricant along the sidewall of the bore 102 to provide contact with the sealing elements 130 and 134.

The embodiments of FIGS. 7 and 8 also include a pressurized fluid biasing means 60' in the form of a gas spring which exerts a closing force on the respective valve members 126 and 128. The valve member 128 of FIG. 8 also preferably contains a hollow interior portion 136' in order to reduce the mass thereof. The valve members 126 and 128 also each carry an enlarged plunger section 118' which acts as a decelerating means through the hydraulic action of the liquid trapped within the throat section 120' of the bore 102 when the valve member moves to the open position.

There are other alternative constructions for the housing 3 which would be apparent to those skilled in the art in light of the description of the invention contained herein. One such modification would be to cast the spherical housing in two pieces, in the form of hemispheres. One of these hemispheres could be cast with an integral cylindrical portion forming the center body thereof with the passage ways for venting and introduction of pressurized fluid being directly formed by way of casting or by subsequent drilling and machining operations. These hemispheres, after machining, could then be joined by welding, bolting, or the like.

Figure 9:
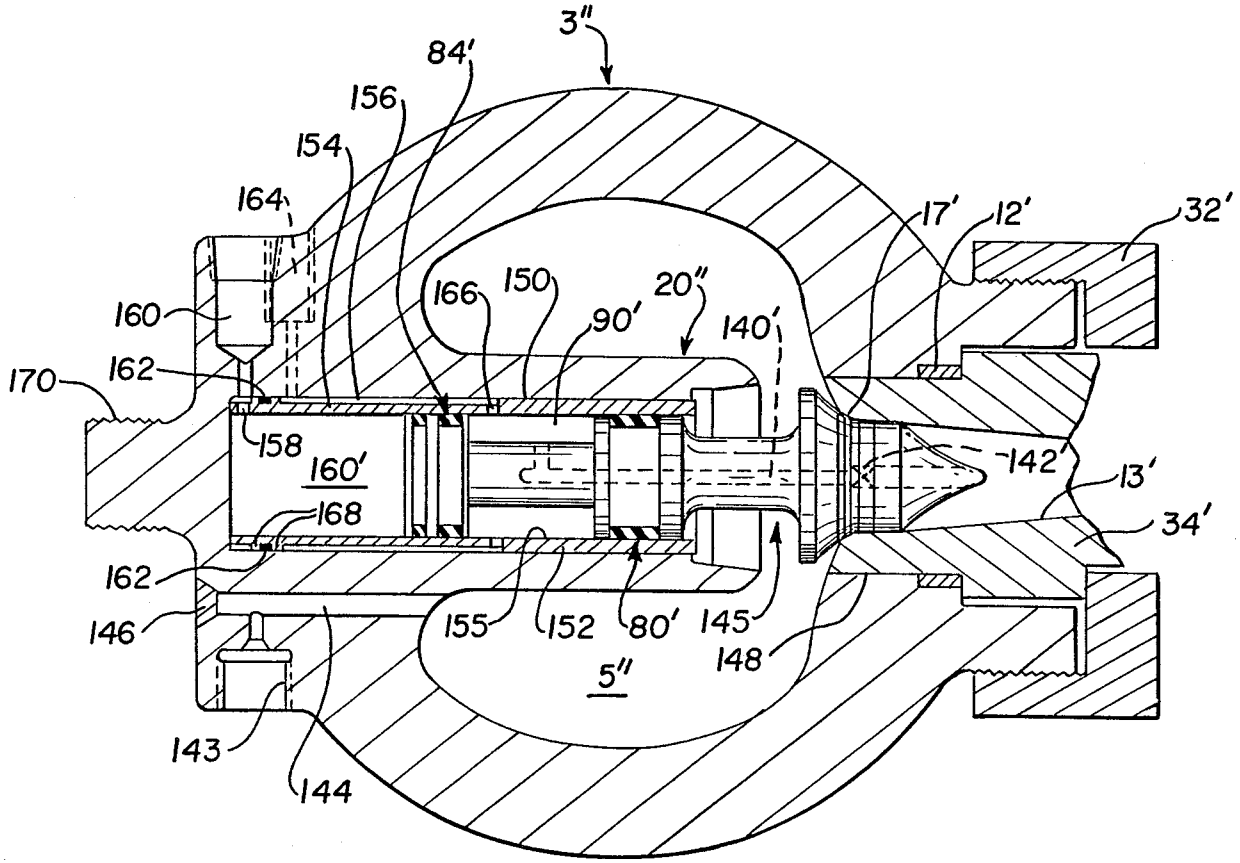
FIG. 9 is a partially fragmented, cross-sectional view of another embodiment of the present invention.

A further preferred construction of the housing is shown in FIG. 9 wherein a spherical housing 3'' is cast as a single piece, with an integral center body 20'' cast within chamber 5'' thereof. The housing has a bore 148 at the nozzle end thereof to permit core placement and removal in a conventional casting operation. The center body 20'' has a cylindrical bore 150 therein preferably formed during the casting operation. A liquid inlet passage 144 is also cast or drilled within the wall of the housing 3'', having one end in communication with the chamber 5''. The other end of the passage 144, at the rear face of the housing 3'', is closed-off with a metal plug 146. A liquid orifice 143 is formed within the housing 3'' in communication with the inlet passage 144 to permit the supply of pressurized liquid, preferably water, to the chamber 5'', as previously described. The nozzle assembly, employing the base element 34' and locking collar 32' are also similar to those described above.

A cylindrically shaped wear sleeve 152 is press fitted within the bore 150 of the center body 20'' and has an inside bore 155 of constant diameter for slidably receiving the valve member 145 therein. The wear sleeve, formed of a wear and corrosion resistant material, can be replaced to extend the useful life of the apparatus. A passage 158 is formed through the wear sleeve 152 near the rearward end thereof communicating with the pressurized fluid supply orifice 160 and the pressurized fluid storage area 160' of the fluid biasing means. Pressurized fluid, such as gaseous nitrogen, is injected into the storage chamber 160' by way of the supply orifice 160 and the passage 158 to apply the previously described gas spring biasing force to the valve member 145 to close-off the seat 17' of the nozzle passage 13'.

The valve member 145 shown in FIG. 9 functions in a similar manner to the valve member of FIG. 8. The liquid sealing means 80' and the fluid sealing means 84' are carried by the valve member 145 and together these sealing means define a liquid and fluid free, sealed-off area 90' therebetween. The liquid and fluid sealing means 80' and 84', respectively, comprise one or more seal elements with bore rider rings secured adjacent thereto to prevent the valve member from contacting and scoring the bore 155. In this manner, liquid and fluid leakage between the seal elements and the bore is prevented.

The valve member 145 also has a vacuum breaker passage 140' formed therein communicating at one end with the nozzle passage 13' when the valve member 145 is in the closed position shown in FIG. 9. The other end of the passage 140' is in communication with the sealed-off area 90' of the bore 155' to receive pressurized gas, such as air or nitrogen, or the like to clear the nozzle passage 13' of liquid after each pulse, in the manner previously described. A one-way check valve 142' is also provided within passage 140' to prevent back-flow of high pressure liquid from chamber 5'' into the passage 140'. In order to supply the required pressurized gas to the passage 140', the wear sleeve 152 has a reduced diameter portion 154 around its outer circumference which forms an annular passage 156 between the outer wall of the wear sleeve 152 and the bore 150 of the center body 20''. An orifice 164 connected to a source of pressurized air or nitrogen or the like is formed in the housing 3'' and communicates with the annular passage 156. One or more holes 166 are formed through the wear sleeve 152 communicating with the annular passage 156 at one end, and the sealed-off area 90' at the other. In this manner, pressurized gas flow is established between the orifice 164 and the passage 140' of the valve member 145 to insure that the nozzle passage 13' is cleared of liquid after each slug is ejected. A source of lubricant may also be introduced into the pressurized gas supplied through the orifice 164 to provide the sealing means 80' and 84' with a supply of lubricant in the manner previously described.

In order to prevent fluid leakage from the storage area 160' of the gas spring into the annular passage 156, a ring seal 162 is provided around the wear sleeve 152 to coact with the bore 150 of the center bore between the communication points of the gas orifices 160 and 164. The seal 162 segregates the respective gas flows from orifices 160 and 164 to prevent an unwanted pressure drop in the storage area 160' of the biasing means. The seal 162 is held in place by a pair of spaced-apart, raised ribs 168 formed on portion 154 of the wear sleeve 152. The ribs 168 have a diameter nearly equal to that of the bore 150 of the center body 20''. Hence, the ribs 168 also function as a means for centering the reduced diameter portion 154 within the bore 150 to provide uniform spacing for the annular passage 156 existing between the wear sleeve 152 and the bore 150.

The one-piece housing 3'' of FIG. 9 also carries an integral, threaded hub 170 at its rearward end which may conveniently be secured to a handle or other mounting means. Disassembly of the nozzle elements and any such handle or other mounting means is rapid and compact transport of the device is achieved with relative ease and simplicity.

By way of example, in applying the invention to apparatus to be handled by one man in cutting rock, concrete and other hard materials in place of the conventional jackhammer, pressurized water at about 20,000 pounds per square inch can be supplied to a chamber having an inside diameter of about 8 inches. Such pressure would result in a compression of water of about 5% and would eject slugs of water having a volume of about 13 cubic inches into the nozzle with a pulse energy of about 10,000 foot-pounds each. At the pressure given, the chamber housing stretches, thereby storing additional recoverable energy. For a spherical chamber made of titanium, which has a low value of modulus of elasticity compared to steel, the energy stored in the wall could easily amount to over 1000 foot-pounds, allowing significantly increased total pulse energy without increased water consumption. Said sphere could weigh less than forty pounds and would be very corrosion resistant.

The above figures are exemplary only and are not to be considered as limiting. In addition, application of the invention is not limited to hand held devices for cutting hard substances, but it may be used in many applications where single or repetitive, high energy pulsed liquid jets are useful. In fact, those skilled in the art will appreciate that various combinations of and modifications and alternatives to the examples given could be developed in light of the overall teachings of the disclosure. Accordingly, the particular arrangements and applications disclosed are meant to be illustrative only and not limiting as to the scope of the invention which is to be given the full breadth of the appended claims and any and all equivalents thereof.

What is claimed is:

1. Apparatus for accelerating a slug of liquid comprising:

a housing forming a substantially rigid closed chamber suitable for storing pressurized liquid at pressures greater than about 5,000 psi;

means for introducing liquid into the closed chamber under pressure to compress liquid in the chamber and thereby store energy primarily by liquid compression and mass in the closed chamber;

a nozzle connected to the housing and having a passage therethrough with an inlet which communicates with the closed chamber formed by the housing and an exit;

valve means for selectively sealing the nozzle passage relative to the closed chamber and operative at liquid pressures greater than about 5,000 psi from a closed to an open to a closed position to release a slug of liquid driven from the closed chamber into the nozzle passage by the energy stored in the compressed liquid, the rate of opening of said valve means being sufficiently rapid that the valve means is substantially fully opened in less time than is required for the leading edge of the liquid slug to reach the nozzle exit; and means for breaking a vacuum in the nozzle passage after each slug is released.

2. The apparatus of claim 1 wherein said valve means includes a valve member which, in the closed position of the valve means, seats against the nozzle inlet to block the release of liquid through the passage and is provided with an extension on the end thereof which slidably fits in sealing relationship inside the nozzle passage, said extension being of such a length that as the valve member is moved from the closed position toward the open position, the extension continues substantially to block the release of liquid through the nozzle passage until the valve member has accelerated to a speed which opens the passage at said rapid rate as the extension clears the nozzle passage.

3. The apparatus of claim 2 wherein said nozzle is a cumulation nozzle.

4. The apparatus of claim 2 including means for biasing the valve means to the open and closed positions.

5. The apparatus of claim 4 wherein said nozzle is a cumulation nozzle.

6. The apparatus of claim 1 wherein said valve means includes means for biasing the valve means to the closed position.

7. The apparatus of claim 6 wherein the valve means includes means responsive to the pressure of the compressed liquid in the chamber to operate the valve means to the open position when the pressure exceeds a selected value and wherein the biasing means is operative to close the valve means when the pressure of the compressed liquid in the chamber drops below the selected value such that the valve means will repetitively open and close to release a series of slugs of liquid into the nozzle passage.

8. The apparatus of claim 1 wherein the valve means includes means which generates a force which biases the valve means to the closed position and means upon which the pressure of the compressed liquid in the closed chamber exerts an opening force tending to drive the valve means to the open position, said valve means repetitively opening when the opening force generated by the compressed liquid exceeds the biasing force, and closing when the release of liquid causes the opening force to fall below the biasing force, such that a series of slugs of liquid are released into said nozzle.

9. The apparatus of claim 1 wherein the housing forming the closed chamber is composed of a material which is elastically deformed by the pressure exerted by the compressed liquid in the chamber to store additional energy which is available to drive said slug of liquid from the chamber into the nozzle passage when the valve means is opened.

10. The apparatus of claim 1 wherein the valve means includes means containing a compressed fluid which biases the valve means to the closed position and also includes means upon which the pressure of the compressed liquid in the closed chamber exerts an opening force including an unseating force tending to unseat and rapidly drive the valve means to the open position, said valve means repetitively opening when the unseating force generated by the compressed liquid exceeds the biasing force, and closing when the release of liquid causes the opening force to fall below the biasing force, such that a series of slugs of liquid are released into said nozzle.

11. The apparatus of claim 10 wherein the valve means includes a center body within the chamber of the housing, having an axial bore formed therein, a valve member having three coaxial first, second, and third portions of increasing cross-sectional areas, the first portion slidably fitting in sealing relation inside the nozzle passage when the valve member is in a closed position, the second portion seating against the inlet end of the nozzle when the valve member is in the closed position and the third portion slidably extending within the bore of the center body, the difference in cross-sectional areas between said second and third portions forming the means against which the compressed liquid exerts the unseating force that is sufficient to overcome the bias force when the liquid pressure exceeds a selected value to unseat the second portion from sealing relation with the inlet end of the nozzle, and the difference in cross-sectional areas between said first and third portions forming the means against which the compressed liquid exerts an increased opening force to drive said valve member rapidly toward an open position, said first portion being of such length that, as the valve member is moved toward the open position, said first portion continues to block the release of liquid into the nozzle passage until the valve member has accelerated to a speed which opens the nozzle passage at said rapid rate as the first portion clears the nozzle passage.

12. The apparatus of claim 11 wherein the compressed fluid biasing means includes a storage chamber for holding a fluid under pressure, said chamber being in fluid communication with the bore of the center body whereby the pressurized fluid applies the biasing force to the third portion of the valve member and wherein said biasing means also serves to assist in decelerating the valve member as it reaches the open position.

13. The apparatus of claim 12 wherein the pressurized fluid of the biasing means is a gas.

14. The apparatus of claim 13 wherein the gas is nitrogen.

15. The apparatus of claim 12 including means on the valve member in addition to the biasing means for decelerating the valve member as it reaches the open position.

16. The apparatus of claim 12 including sealing means coacting between the valve member and the bore of the center body to prevent leakage of compressed fluid and liquid from their respective chambers.

17. The apparatus of claim 16 wherein the sealing means includes fluid sealing means affixed to the valve member adjacent to the end of the third portion and liquid sealing means longitudinally spaced from said fluid sealing means toward said second portion, defining a sealed-off area therebetween along the bore of the center body.

18. The apparatus of claim 17 including vent means having a vent orifice in communication with the sealed-off area of the bore of the center body, whereby inadvertent fluid or liquid leakage through one of said respective sealing means flows through said vent means.

19. The apparatus of claim 1 wherein said nozzle is a cumulation nozzle.

20. Apparatus for accelerating a slug of liquid, comprising:

a housing forming a closed chamber for pressurized liquid;

means for introducing liquid into the closed chamber under pressure to compress liquid in the chamber and thereby store energy and mass in the closed chamber;

a nozzle connected to the housing and having a passage therethrough with an inlet which communicates with the closed chamber formed by the housing and an exit; and valve means for selectively sealing the nozzle passage relative to the closed chamber and operative from a closed to an open to a closed position to release a slug of liquid driven from the closed chamber into the nozzle passage by the energy stored in the compressed liquid, the rate of opening of said valve means being sufficiently rapid that the valve means is substantially fully opened in less time than is required for the leading edge of the liquid slug to reach the nozzle exit;

the valve means including means containing a compressed fluid which biases the valve means to the closed position and also includes means upon which the pressure of the compressed liquid in the closed chamber exerts an opening force including an unseating force tending to unseat and rapidly drive the valve means to the open position, said valve means repetitively opening when the unseating force generated by the compressed liquid exceeds the biasing force, and closing when the release of liquid causes the opening force to fall below the biasing force, such that a series of slugs of liquid are released into said nozzle;

the valve means further including a center body within the chamber of the housing, having an axial bore formed therein, a valve member having three coaxial first, second, and third portions of increasing cross-sectional areas, the first portion slidably fitting in sealing relation inside the nozzle passage when the valve member is in a closed position, the second portion seating against the inlet end of the nozzle when the valve member is in the closed position and the third position slidably extending within the bore of the center body, the difference in cross-sectional areas between said second and third portions forming the means against which the compressed liquid exerts the unseating force that is sufficient to overcome the bias force when the liquid pressure exceeds a selected value to unseat the second portion from sealing relation with the inlet end of the nozzle, and the difference in cross-sectional areas between said first and third portions forming the means against which the compressed liquid exerts an increased opening force to drive said valve member rapidly toward an open position, said first portion being of such length that, as the valve member is moved toward the open position, said first portion continues to block the release of liquid into the nozzle passage until the valve member has accelerated to a speed which opens the nozzle passage at said rapid rate as the first portion clears the nozzle passage;

the compressed fluid biasing means comprising a storage chamber for holding a fluid under pressure, said chamber being in fluid communication with the bore of the center body whereby the pressurized fluid applies the biasing force to the third portion of the valve member; and means in addition to the biasing means for decelerating the valve member as it reaches the open position, comprising a plunger carried by the valve member which projects into a throat section of the bore of the center body as the valve member approaches the open position to provide dampening as the liquid is forced out of the throat section through a restrictive clearance between the plunger and the wall of the throat section.

21. The apparatus of claim 20 wherein said nozzle is a cumulation nozzle and further including means for breaking a vacuum in said nozzle passage after each slug is released.

22. Apparatus for accelerating a slug of liquid, comprising:

a housing forming a closed chamber for pressurized liquid;

means for introducing liquid into the closed chamber under pressure to compress liquid in the chamber and thereby store energy and mass in the closed chamber;

a cumulation nozzle connected to the housing and having a passage therethrough with an inlet which communicates with the closed chamber formed by the housing and an exit; and valve means for selectively sealing the nozzle passage relative to the closed chamber and operative from a closed to an open to a closed position to release a slug of liquid driven from the closed chamber into the nozzle passage by the energy stored in the compressed liquid, the rate of opening of said valve means being sufficiently rapid that the valve means is substantially fully opened in less time than is required for the leading edge of the liquid slug to reach the nozzle exit;

the valve means including means containing a compressed fluid which biases the valve means to the closed position and also includes means upon which the pressure of the compressed liquid in the closed chamber exerts an opening force including an unseating force tending to unseat and rapidly drive the valve means to the open position, said valve means repetitively opening when the unseating force generated by the compressed liquid exceeds the biasing force, and closing when the release of liquid causes the opening force to fall below the biasing force, such that a series of slugs of liquid are released into said nozzle;

the valve means further including a center body within the chamber of the housing, having an axial bore formed therein, a valve member having three coaxial first, second, and third portions of increasing cross-sectional areas, the first portion slidably fitting in sealing relation inside the nozzle passage when the valve member is in a closed position, the second portion seating against the inlet end of the nozzle when the valve member is in the closed position and the third portion slidably extending within the bore of the center body, the difference in cross-sectional areas between said second and third portions forming the means against which the compressed liquid exerts the unseating force that is sufficient to overcome the bias force when the liquid pressure exceeds a selected value to unseat the second portion from sealing relation with the inlet end of the nozzle, and the difference in cross-sectional areas between said first and third portions forming the means against which the compressed liquid exerts an increased opening force to drive said valve member rapidly toward an open position, said first portion being of such length that, as the valve member is moved toward the open position, said first portion continues to block the release of liquid into the nozzle passage until the valve member has accelerated to a speed which opens the nozzle passage at said rapid rate as the first portion clears the nozzle passage;

the compressed fluid biasing means comprising a storage chamber for holding a fluid under pressure, said chamber being in fluid communication with the bore of the center body whereby the pressurized fluid applies the biasing force to the third portion of the valve member;

sealing means coacting between the valve member and the bore of the center body to prevent leakage of compressed fluid and liquid from their respective chambers, the sealing means including fluid sealing means affixed to the valve member adjacent to the end of the third portion and liquid sealing means longitudinally spaced from said fluid sealing means toward said second portion, defining a sealed-off area therebetween along the bore of the center body;

vent means having a vent orifice in communication with the sealed-off area of the bore of the center body, whereby inadvertent fluid or liquid leakage through one of said respective sealing means flows through said vent means; and vacuum breaking means comprising a passage extending through said valve member and communicating both with the nozzle passage through the first portion of the valve member and a source of a pressurized gas outside of the housing communicating through a side of the valve member at the sealed-off area of the center body and communicating with the vent orifice formed therein, whereby said pressurized gas flows from said source through the vent orifice to the sealed-off area and thence to the passage of the valve member to enter the nozzle passage when the valve member is in the closed position, said gas being at a pressure sufficient to break the vacuum in the nozzle passage and empty substantially all liquid from the nozzle passage before the next liquid slug is ejected into the nozzle passage.

23. The apparatus of claim 22 including check valve means operably positioned in the passage of the valve member to permit the flow of pressurized gas to the nozzle passage when the valve member is in the closed position and to block the flow of pressurized liquid into the passage of the valve member when said valve member is in the open position.

24. The apparatus of claim 22 including means communicating with the source of pressurized gas for the introduction of a lubricant into the gas stream, whereby said liquid sealing means and said fluid sealing means are exposed to said lubricant as said lubricant and pressurized gas mixture passes through the sealed-off area.

* * * * *